United States Patent [19]

Piepers

[11] Patent Number: 4,514,264

[45] Date of Patent: Apr. 30, 1985

[54] METHOD AND DEVICE FOR GALVANICALLY APPLYING A METAL COATING ON METAL OBJECTS

[75] Inventor: Harry C. Piepers, Eindhoven, Netherlands

[73] Assignee: Meco Equipment Engineers B.V., Netherlands

[21] Appl. No.: 581,930

[22] Filed: Feb. 21, 1984

[51] Int. Cl.[3] ..... C25D 5/02; C25D 5/08; C25D 17/28

[52] U.S. Cl. ..... 204/15; 204/206; 204/224 R

[58] Field of Search ..... 204/15, 206, 224 R

[56] References Cited

U.S. PATENT DOCUMENTS

| | | | |
|---|---|---|---|
| 4,229,269 | 10/1980 | Buckley | 204/206 |
| 4,230,538 | 10/1980 | Turner | 204/224 R |
| 4,278,520 | 7/1981 | Turner | 204/15 |
| 4,364,801 | 12/1982 | Salama | 204/15 |
| 4,376,683 | 3/1983 | Hellwig | 204/15 |
| 4,441,966 | 4/1984 | Onda | 204/224 R |

FOREIGN PATENT DOCUMENTS

| | | | |
|---|---|---|---|
| 142891 | 11/1981 | Japan | 204/206 |

*Primary Examiner*—Thomas Tufariello

*Attorney, Agent, or Firm*—Alan H. MacPherson; Steven F. Caserza; Richard Franklin

[57] ABSTRACT

A method of galvanically applying a metal coating to metal objects with the aid of an electrolyte which is brought into contact with at least the parts of the metal objects to be covered with metal, the metal objects being guided along the outer circumference of a curved surface whereby the electrolyte is guided in the form of a thin curtain at least substantially tangentially to the parts to be covered with metal of the objects adhering in an elongate tape so that after having passed along the parts to be covered the electrolyte can freely flow away without coming into contact with other parts of the objects.

17 Claims, 9 Drawing Figures

METHOD AND DEVICE FOR GALVANICALLY APPLYING A METAL COATING ON METAL OBJECTS

The invention relates to a method of galvanically applying a metal coating to metal objects with the aid of an electrolyte which is brought into contact with at least the parts of the metal objects to be coated with metal whilst the metal objects are guided along a curved surface.

In the electro-technical industry recent decades have shown a strong increase in the demand for metal objects locally covered by a metal coating usually consisting of a high-quality material, for example, gold or silver. Such a local coating of a metal object is frequently required for obtaining a satisfactory connection of parts with one another and/or a satisfactory electrical contact between different parts, for example, in the case of connecting plugs, contact elements for telecommunication apparatus, computers and the like, in which usually a low contact resistance is required at connections or contacts.

Frequently only local coating of the metal objects with the metal, particularly the precious metal, is required and also due to the high cost price of the precious metal the tendency is to provide exclusively the required parts of the metal objects with the metal coating.

From Dutch Patent Specification No. 150,860 there is known a method and a device for applying a dash-like metal layer to a metal tape. The metal tape is guided around a wheel, whilst the electrolyte is sprayed at right angles to the tape surface on that part of the tape which has to be provided with the metal layer.

A similar method and device are described in Dutch Patent Application No. 7316244 for applying metal coatings in the form of given, desired patterns.

These known methods in themselves are, indeed, satisfying, but they are mainly intended for working continuous tapes and in several cases the methods and devices disclosed in the above-mentioned publications are less suitable for locally coating metal objects. For example metal objects are frequently formed by stamping and/or bending metal tapes, whilst the objects afterwards can be separated from one another for final use. It is then often preferred to first work the tapes mechanically by stamping and/or bending the tape, for example, to form plug elements, which remain in connection with parts of the tape in order to provide the desired parts of the plug elements with a metal coating after accomplishment of the mechanical operation.

During the mechanical preparation of metal tapes by stamping and/or bending the tapes exhibit a so-called sabre formation, that is to say, a deformation of the tape in the plane of the tape about an axis at right angles to the surface of the tape. Moreover, the tape will be subjected to torsion, that is to say, a turn of the tape about its longitudinal axis.

Dutch Patent Application No. 7407632 describes a method of local application of a metal coating or the like to products still adhering to one another in an endless tape. In this case during operation the products are passed by a guide system along a rotating roller in a direction parallel to the rotary axis of the roller partly dipped in an electrolyte solution. However, due the aforesaid sabre formation and torsion of the tape formed by the adhering products even a complicated guide system for the tape can practically not ensure that the product tape will be guided with such accuracy that the products are provided solely at the desired places with a metal coating.

U.S. Pat. No. 4,229,269 also discloses a method of locally coating metal objects. Herein the objects are displaced on a straight line and also in this case, due to the said sabre formation and the torsion of the tape, it will be very difficult to guide the objects correctly and accurately along an accurately defined path in a manner such that all objects are provided at the correct place with a coating. In this case a fluid curtain is directed at least substantially at right angles to the objects to be coated. In this way accurate definition of the surfaces of the objects to be coated cannot be guaranteed, since the fluid will tend to shift along the surface of the objects.

Similar disadvantages will occur in the device described in European Patent Application No. 059787. Also in this case objects interconnected in a tape are guided along a straight path past spraying nozzles at right angles to the objects. Consequently serious problems will occur in this case with respect to accurate guidance of the tape, whilst in addition accurate delimitation of the surface to be coated cannot be ensured because the fluid is sprayed onto the objects at right angles thereto.

German Patent Application No. 2,705,158 proposes a method in which the electrolyte is allowed to flow out of a nozzle in a direction to a suction tube arranged below said nozzle. An object to be coated is disposed in the proximity of the jet formed between the nozzle and the suction tube so that this object is locally wetted by the jet. This publication does not provide any indication of the manner in which the objects have to be moved into the proximity of the jet. Moreover the means required for sucking out the electrolyte with the aid of a pressurized member will lead to a complicated construction of the device for treating the objects concerned.

The problems involved in correctly guiding and accurately applying coatings due to sabre-formation and torsion of the tape can be avoided in a simple manner by moving the objects along a curved surface and, in addition, in accordance with the invention, by guiding the electrolyte in the form of a thin curtain by pressure at least substantially tangentially to the parts of the objects adhering to one another in an elongate tape to be coated with a metal in a manner such that after having passed along the parts to be coated the electrolyte can freely flow away without further coming into contact with said parts which allows a very accurate, local application of the desired coating on the metal objects, since the pressurized jet can be satisfactorily directed with respect to the moving objects without the occurrence of an undesirable deflection of the jet when the objects come into contact with the jet. Since the fluid is subjected to pressure, it can move, after having passed the objects to be treated at the desired places, to a sufficient further extent to be subsequently collected at a desired place without causing undesired wetting of parts of the objects not to be treated.

The invention will be described more fully hereinafter with reference to a few embodiments shown in the Figures of the construction in accordance with the invention.

Figure 3:
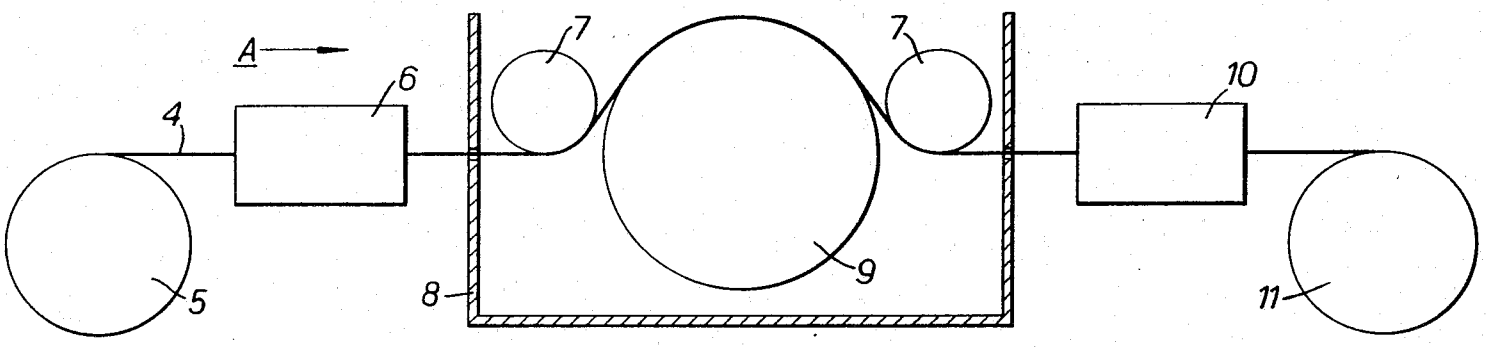

FIG. 3 schematically shows an embodiment of a device in accordance with the invention.

Figure 4:
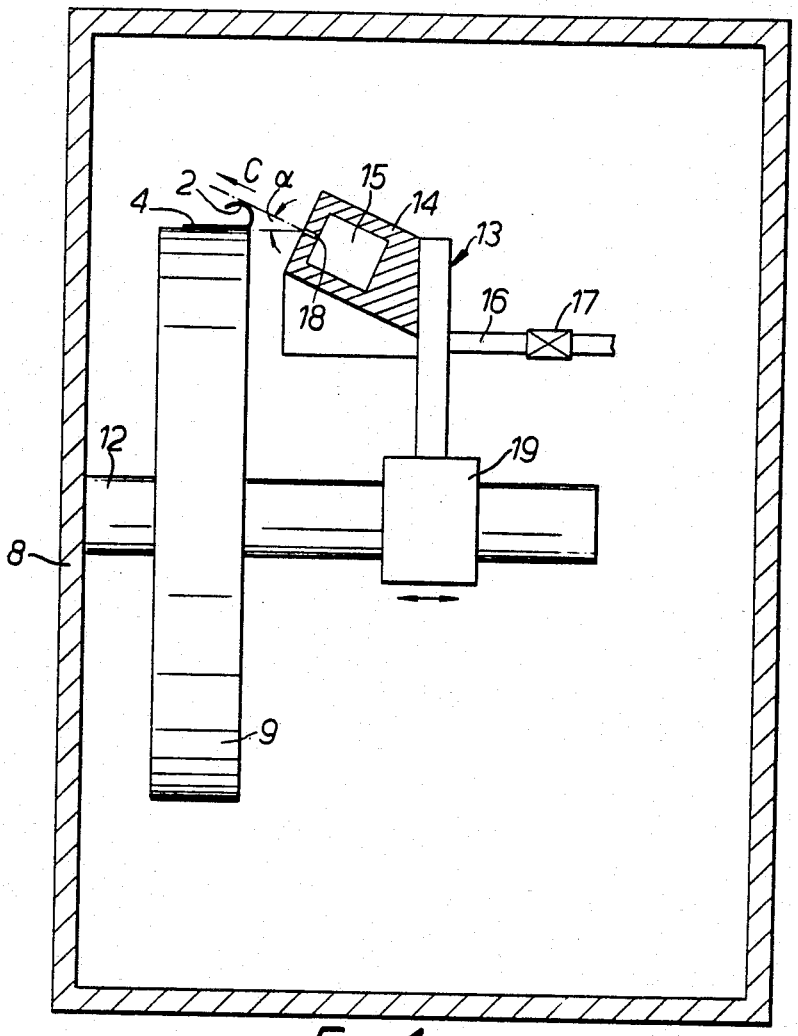

FIG. 4 schematically shows on an enlarged scale part of the device shown in FIG. 3.

Figure 5:
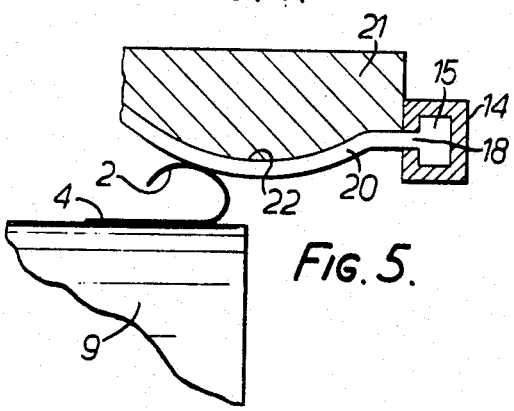

FIG. 5 schematically shows the design of a second embodiment of a device in accordance with the invention.

Figure 6:
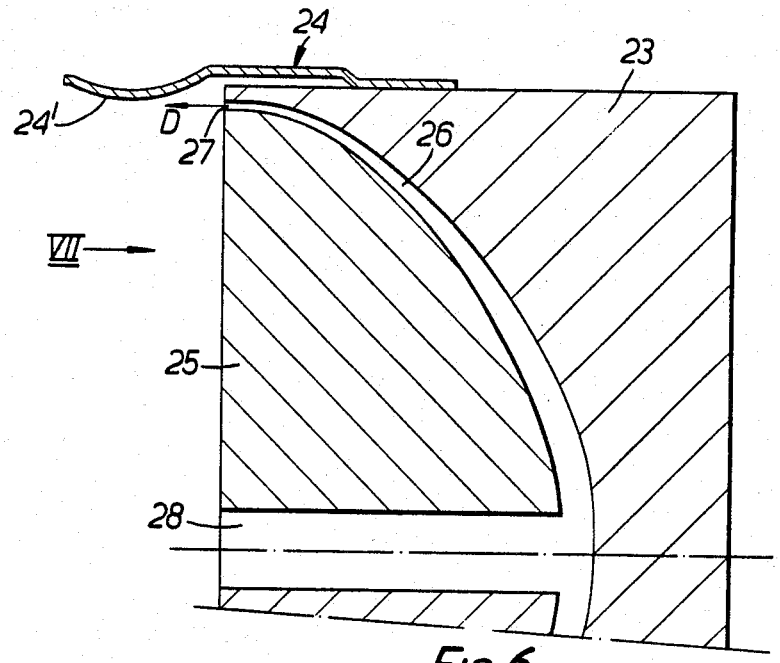

FIG. 6 is a schematic sectional view of a third embodiment of a device in accordance with the invention.

Figure 7:
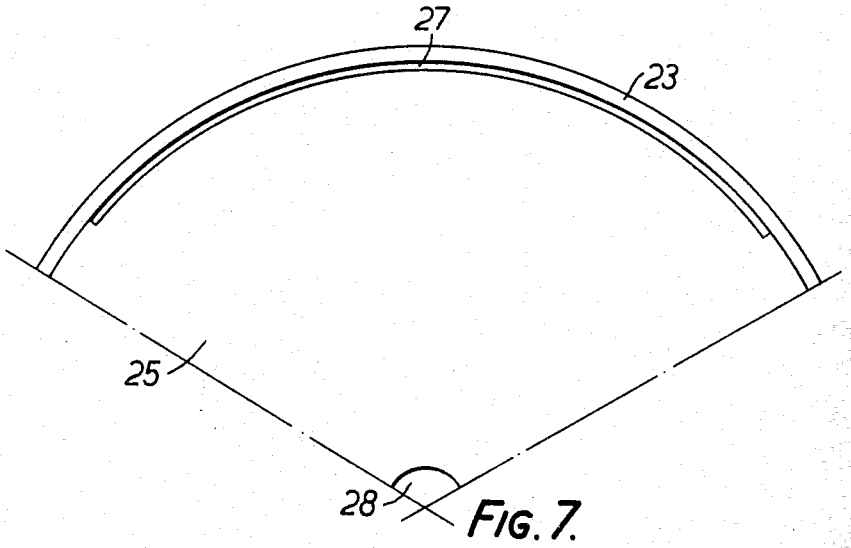

FIG. 7 shows part of the device shown in FIG. 6 in the direction of the arrow VII in FIG. 6.

Figure 8:
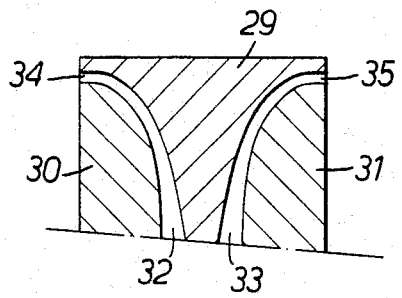

FIG. 8 is a schematic sectional view of part of a fourth embodiment of a device in accordance with the invention.

Figure 9:
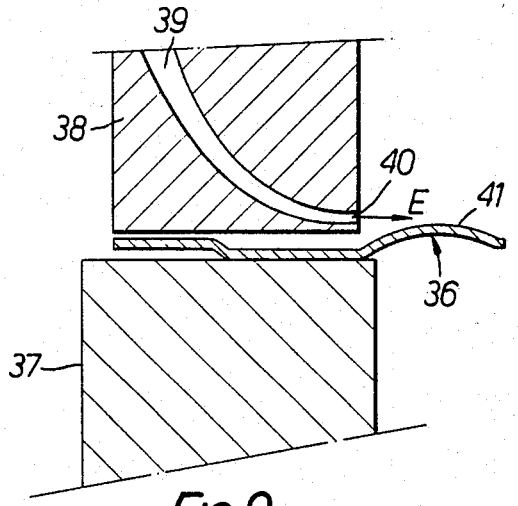

FIG. 9 is a schematic sectional view of part of a fifth embodiment of a device in accordance with the invention.

Figure 1:
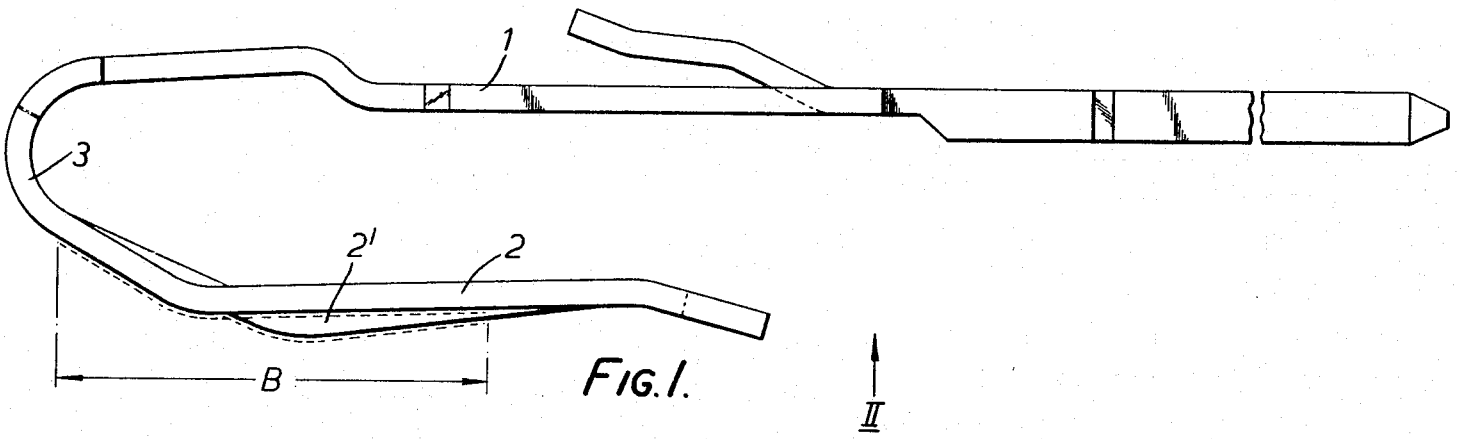
FIG. 1 is a schematic side elevation of an embodiment of an object that can be locally provided with a metal coating by carrying out the method embodying the invention.
Figure 2:
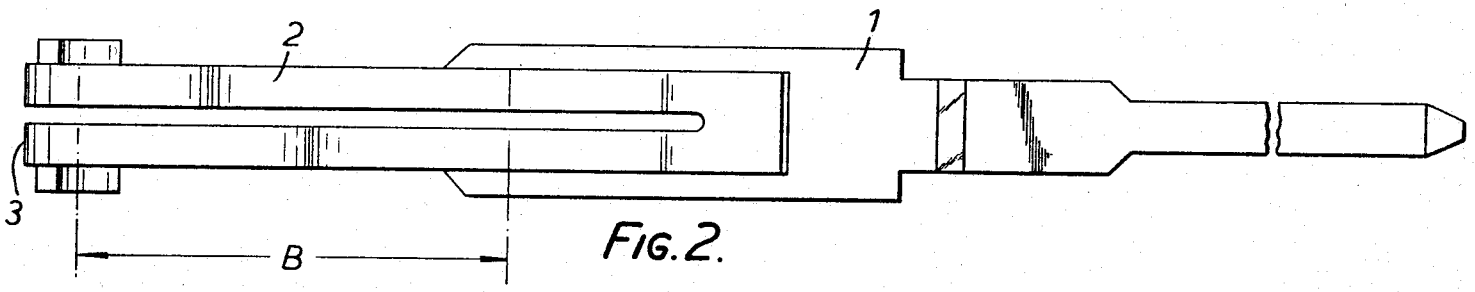
FIG. 2 is an elevational view in the direction of the arrow II in FIG. 1.

The method embodying the invention is particularly suitable for example, for locally applying a metal layer to plug elements of metal of the construction shown in FIGS. 1 and 2. Such an element comprises two limbs 1 and 2 interconnected by a curved part 3.

From FIG. 1 it is apparent that the part 2 is formed by two parts being at an angle to one another and for the use of such plug elements it is often desired to cover the limb 2 in the region B with a precious metal layer 2′ (indicated by broken lines).

Such objects are frequently punched and bent out of tape-shaped material. For applying the precious metal coatings the tape-shaped material is worked so that the various plug elements shown in FIGS. 1 and 2 remain adhering to one another so that the objects can be passed in the form of an endless tape through a device for applying the local coatings of precious metal.

Such a device may be designed as is schematically shown in FIG. 3. An endless tape 4 formed, for example, by relatively adhering objects having more or less the form of the plug elements shown in FIGS. 1 and 2 can be wound off a reel 5 to be first passed through a degreasing device 6 or the like forming part of said device. Then with the aid of two guide rollers 7 the tape is guided along a freely rotatable wheel 9 arranged in a trough 8, after which it is supplied to an aftertreatment part 10 for flushing, drying or the like. After the passage through the aftertreatment part 10 the tape 4 can again be wound on a reel 11 or it may be supplied to further working devices or the like, for example, for severing the plug elements.

In order to ensure correct positioning of the tape on the circumference of the wheel 9 the guide rollers 7 may, if desired, be axially adjustable. Moreover, the endless tape 4 can be connected in a manner not shown, but known per se, for example, via the guide rollers 7 to the negative terminal of a direct-current source.

FIG. 4 furthermore shows that the wheel 9 is freely rotatable on a shaft 12 arranged in the trough 8. Opposite the top part of the wheel 9, along which the tape 4 is moving, a device 13 for supplying electrolyte is arranged. Near or in said device may be arranged an anode connected to the positive terminal of said direct-current source so that it is in contact with the supplied electrolyte. If desired, parts of the electrolyte supply device itself may be used as an anode by using appropriate material and a suitable disposition of said parts.

The device comprises a chamber 15 arranged in a housing 14 to which pressurized electrolyte can be fed through a duct 16 communicating with the chamber 15. As is schematically shown in FIG. 4 said feeding duct 16 preferably includes an adjustable control-cock 17.

A wall of the housing 14 has a thin outlet slot 18 being in open communication with the chamber 15 and being concentric with the centre line of the shaft 12 and having its outlet preferably coplanar with the outer circumference of the wheel 9 as is shown in FIG. 4. The outlet slot 18 has a shape such that, viewed in a radial plane going through the centre line of the shaft 12, the longitudinal axis of the slot is at an angle $\alpha$ of preferably between 15° and 30° to a line parallel to the centre line of the shaft 12 and going through the outlet of the slot 18. The slot 18 may furthermore subtend a circumferential angle of e.g. 90° around the centre line of the shaft 12. The electrolyte feeding device is preferably arranged by means of a hub 19 so as to be displaceable on the shaft 12 in a direction parallel to the centre line of the shaft 12 so that the device 13 can be fixed at any desired distance from the wheel 9 on the shaft 12.

During operation 1 the tape 4 consisting, for example, of relatively adhering plug elements more or less of the shape of the plug elements shown in FIGS. 1 and 2 may be passed in the direction of the arrow A (FIG. 3) through the device and along the outer circumference of the wheel 9, which will be caused to rotate by the tape 4 moving in the direction of the arrow A. Since the tape is then tightly stretched around the curved surface of the wheel 9, any torsion and sabre formation in the tape will be eliminated, whilst at the same time with the aid of the guide rollers 7 accurate positioning of the tape on the circumference of the wheel 9 can be ensured so that the position of the tape and in particular the position of the slightly curved or bent parts 2 of the objects is accurately determined during the movement along the circumference of the wheel 9.

By feeding electrolyte under pressure through the duct 16 to the chamber 15, this electrolyte will emerge through the slot 18 in the direction of the arrow C in the form of a thin curtain. The disposition of the electrolyte feeding device 13 is such that, as is schematically shown in FIG. 4, this curtain just touches the curved parts 2 of the objects to be provided with a metal layer so that exactly the desired, curved parts will be provided with a metal coating.

Since the electrolyte feeding device 13 is adjustable in the longitudinal direction of the shaft 12 with respect to the wheel 9 the position of the electrolyte curtain emerging from the slot 18 can be adapted in a simple manner to variations, if any, in dimensions and shape of the products to be worked. In practice it has been found that an advantageous effect is already obtained when in the chamber 15 such a pressure is maintained during operation that the exit speed of the electrolyte from the slot 18 lies between 3 and 25 m/sec. In most cases speeds lying between 6 and 10 m/sec. will be particularly effective. Advantageously the width of the slot lies between 0.1 and 5 mm, preferably between 0.3 and 1.5 mm. The circular shape of the electrolyte curtain emanating from the slot can be maintained over a distance of at least 50 mm, which will largely be sufficient in practice.

During operation the speed of the fluid can be readily influenced with the aid of the control-cock 17.

Although in the foregoing the invention is explained at least mainly with reference to an embodiment in which relatively adhering plug elements forming a tape have to be locally provided with a metal layer, it will be obvious that the method and device embodying the invention may be used as well in a different manner. For example, separately manufactured elements may be fastened to a carrying belt which is then passed through the device in the same manner as described above for the tape 4 for locally covering the objects on the carrying belt. A further possibility resides in that an object formed by a tape having a given profile is passed through the device in the same manner as described for the tape 4, for example, to provide a given surface part extending in the direction of length of said profiled tape with a metal layer.

In this way many supplements and modifications of the method and device described above can be carried into effect within the spirit and scope of the invention.

FIG. 5 shows, by way of example, a device in which the so-called Coanda effect is used. Parts corresponding with parts discussed with reference to the preceding Figures are designated by the same reference numerals as in the preceding Figures.

The housing 14 is disposed so that the outlet slot 18 is at least substantially horizontal. It is noted that the outlet slot and the electrolyte curtain 20 emanating from said slot during operation are represented with exaggerated thickness for the sake of clarity.

At the outlet slot 18 of the housing 14 there is arranged a guide member 21 having a curved boundary surface 22 disposed opposite the path of the parts 2 of a tape 4 to be provided with a metal layer so that the centre of curvature of the curved wall part 22 is located on the side of the curved surface 22 remote from the objects to be treated.

The fluid curtain emerging under pressure from the slot 18 now tends to continue following this curved surface 22 and for adaptation to the objects to be worked the course of said surface is chosen so that the electrolyte curtain is guided at least substantially tangentially to the parts of the objects to be worked to be provided with the metal layer. In this method and device the influence of variations in the pressure of the fluid fed to the chamber 15 and of variations in the composition of the electrolyte is smaller than in the method first described.

In the embodiment shown schematically in FIGS. 6 and 7 a wheel 23 is used, along the outer circumference of which is guided a tape formed by relatively adhering objects 24. The correct guidance of the tape along the wheel can be ensured in the same manner as described above with reference to the first embodiment, that is to say, for example, with the aid of guide rollers 7.

The wheel 23 has a cavity receiving a body 25 in fixed position so that between the proximal boundary walls of the wheel 23 and the body 25 a passage 26 is formed, opening out on the side of the wheel and the body in an outlet slot 27 subtending, for example, a circumferential angle of about 90°. Pressurized electrolyte can be fed through a channel 28 provided in the stationary part 25 to the passage 26 so that the pressurized fluid will emerge from the slot 27 in the direction of the arrow D.

It will be apparent that the jet thus emerging will cover the undersides of the depressed parts 24' of the objects 24 to be provided with precious metal, said parts being passed by the rotating wheel 23 along the emerging jet. In this embodiment the jet is sprayed in a direction away from the part of the object adjoining the end of the object 24 to be provided with a coating so that the risk of contact between the emerging jet and parts of the object not to be covered is practically fully excluded. In this embodiment it may be conceived to dispose the two parts 23 and 25 in fixed positions and to cause an annular wheel to turn about the part 23 along which the tape of objects 24 is guided. However, the embodiment shown in FIG. 6 is preferred since herein a very accurate disposition of the objects with respect to the outlet slot 27 for the fluid jet can be ensured.

FIG. 8 schematically shows an embodiment in which a rotatable wheel 29 is provided in the same manner as shown in FIG. 6 on both sides with a recess in each of which is disposed a stationary part 30 and 31 respectively in a manner such that between the rotatable wheel and the two stationary parts 30 and 31 passages 32 and 33 respectively are formed. These passages open out in a manner similar to that of the embodiment shown in FIG. 6 on the side of the wheel in outlet slots 34 and 35 respectively corresponding with the outlet slot 27.

It will be obvious that by means of such a device two tapes guided along the outer circumference of the wheel 29 can be simultaneously worked or a tape comprising objects to be coated near the two longitudinal edges.

In the embodiment shown in FIG. 9 the objects 36 adhering in a tape are guided along the outer circumference of a wheel 37. Around at least part of the outer circumference of the wheel is arranged a stationary body 38 having a passage 39 opening out in an outlet slot 40 subtending, for example, a circumferential angle of about 90° around the outer circumference of the wheel 37. The outlet slot 40 is directed so that a pressurized fluid jet leaving this passage in the direction of the arrow E will brush past the curved parts 41 of the objects 36 to provide these curved parts with the metal coating. Also in this embodiment the fluid jet is sprayed in a direction to the free end of the curved part of the object remote from the further part of the object so that also in this case the risk of contact between the fluid and parts of the object not to be worked is practically excluded.

Although in the embodiments described above the wheels are shown in a vertical position, that is to say, so as to be rotatable about a horizontal rotary axis, a disposition of the wheels is also possible in which the wheels rotate about a vertical rotary axis. However, with regard to better accessibility the vertical disposition shown will usually be preferred.

Furthermore, in contrast to the embodiments described above in which a guide member in the form of a rotatable wheel is used, a stationary guide member may be used. In this case it is not necessary for the curved surface along which the objects to be treated are guided to form part of a circle, since this surface may be curved in a different manner.

I claim:

1. A method of galvanically applying a metal coating to metal objects with the aid of an electrolyte which is brought into contact with at least the parts of the metal objects to be covered with metal, the metal objects being guided along the outer circumference of a curved surface, the electrolyte being expelled from a supply means with a speed of at least 3 m/sec. in the form of a thin curtain at least substantially tangential to the parts to be covered with metal of the objects adhering in an elongate tape, so that after having passed along the parts to be covered, the electrolyte can freely flow away without coming into contact with other parts of the objects.

2. A method as claimed in claim 1 characterized in that a curved electrolyte curtain is formed, the curvature of which matches the curvature of the curved surface along which the metal objects are guided.

3. A method as claimed in claim 1 characterized in that the objects are guided along the circumference of a freely rotatable wheel and the electrolyte is fed to an outlet slot which is concentric with the rotary axis of the wheel.

4. A method as claimed in claim 3 characterized in that the electrolyte is fed from an outlet slot arranged at least substantially in the same plane as the outer circumference of the wheel.

5. A method as claimed in claim 1 characterized in that in those cases in which the parts to be covered are located near the ends of the objects the electrolyte is fed in the direction towards the respective ends.

6. A method as claimed in claim 1 characterized in that the electrolyte is fed with a speed lying between 3 and 25 m/sec., preferably between 6 and 10 m/sec.

7. A device for carrying out the method claimed in claim 1 comprising a freely rotatable wheel along which the objects to be treated can be guided characterized in that the device comprises means for feeding electrolyte, said means having a slot concentric with the rotary axis through which electrolyte can be fed in the direction towards the objects to be treated, said slot communicating with means for feeding an electrolyte under pressure to the device.

8. A device as claimed in claim 7 characterized in that the wheel has a recess bounding a passage opening out in a slot located near the side of the wheel through which electrolyte can be fed in the direction towards the object to be worked.

9. A device as claimed in claim 8 characterized in that the passage is bounded by a side face of the body arranged in the recess of the wheel and a face of the wheel itself.

10. A device as claimed in claim 7 characterized in that near the wheel there is arranged a body having a slot concentric with the rotary axis through which electrolyte can be fed in the direction towards the parts of the objects to be covered.

11. A device as claimed in claim 10 characterized in that the electrolyte feeding device and the wheel are relatively displaceable in a direction parallel to the rotary axis of the wheel.

12. A device as claimed in anyone of the preceding claims 7 to 11 characterized in that the slot has a width lying between 0.1 and 5 mms, preferably between 0.3 and 1.5 mms.

13. A device as claimed in claim 12 characterized in that a control-member is provided for controlling the pressure at which the electrolyte is fed to the slot.

14. A device as claimed in claim 13 characterized in that a guide member is provided for the fluid emanating from the slot, said guide member having a curved surface guiding the fluid.

15. A device as claimed in claim 14 characterized in that guide means for the objects are arranged near the wheel, said guide means being adjustable in a direction parallel to the rotary axis of the wheel.

16. An object provided with a metal layer applied thereto by using the device claimed in claim 15.

17. An object provided with a metal layer applied thereto by using the method claimed in claim 1.

* * * * *